US009497806B2

(12) United States Patent
Lee et al.

(10) Patent No.: US 9,497,806 B2
(45) Date of Patent: Nov. 15, 2016

(54) POWER TRANSFORMATION APPARATUS, ILLUMINATING LAMP, AND LAMP TUBE USING THE SAME

(71) Applicants: LUMIGREEN LIGHTING TECHNOLOGY CO., LTD, Zhubei (TW); Yu Lin Lee, Zhubei (TW)

(72) Inventors: Yu Lin Lee, Zhubei (TW); Lin Kan Weng, Zhubei (TW)

(73) Assignees: Lumigreen Lighting Technology Co., Ltd.; Yu Lin Lee, Zhubei (TW)

( * ) Notice: Subject to any disclaimer, the term of this patent is extended or adjusted under 35 U.S.C. 154(b) by 0 days.

(21) Appl. No.: 14/956,990

(22) Filed: Dec. 2, 2015

(65) Prior Publication Data

US 2016/0262224 A1 Sep. 8, 2016

(30) Foreign Application Priority Data

Mar. 6, 2015 (TW) ..... 104107192 A

(51) Int. Cl.
*H05B 33/08* (2006.01)
*F21K 99/00* (2016.01)
(Continued)

(52) U.S. Cl.
CPC ..... *H05B 33/0809* (2013.01); *F21K 9/17* (2013.01); *F21V 23/026* (2013.01); *H05B 33/0815* (2013.01); *F21Y 2101/02* (2013.01)

(58) Field of Classification Search
CPC ..... H05B 33/0809; H05B 33/0803; H05B 33/0815; H05B 41/28; H05B 41/2881; Y02B 20/342; Y02B 20/208
(Continued)

(56) References Cited

U.S. PATENT DOCUMENTS 7,019,993 B2 * 3/2006 Vazquez Carazo ... H02M 7/003 310/359
7,911,149 B2 * 3/2011 Schaible ..... H05B 33/0815 315/224
(Continued)

FOREIGN PATENT DOCUMENTS

CN 202857097 U 4/2013
TW M444677 U 1/2013
TW 201349926 A 12/2013

*Primary Examiner* — Haissa Philogene
(74) *Attorney, Agent, or Firm* — Alan D. Kamrath; Kamrath IP Lawfirm, P.A.

(57) ABSTRACT

A power transformation apparatus between DC light element and ballast is provided, including: a first inductance, a second inductance, and a rectifier module. The first inductance includes a first input end and a second input terminal, and at least one of the first input terminal and the second input terminal is electrically connected to an output terminal of the ballast. The second inductance has a third input terminal and a fourth input terminal, and at least one of the third input terminal and the fourth input terminal is electrically connected to another output end of the ballast. The rectifier module has two input terminals, and the two input terminals are electrically connected to the first inductance and the second inductance, respectively. The rectifier module inputs a rectified direct current, so as to provide the electricity to the DC light elements. When the ballast is electrical ballast, the impedance value of the first inductance and the second inductance are between 150Ω and 800Ω.

18 Claims, 6 Drawing Sheets

(51) Int. Cl.
*F21V 23/02* (2006.01)
*F21Y 101/02* (2006.01)

(58) Field of Classification Search
USPC .... 315/185 R, 200 R, 209 R, 224, 291, 283, 315/246
See application file for complete search history.

(56) References Cited

U.S. PATENT DOCUMENTS

| | | | | |
|---|---|---|---|---|
| 8,723,433 | B2 | 5/2014 | Liu | |
| 9,000,679 | B2 | 4/2015 | Tsuda | |
| 9,198,246 | B2 * | 11/2015 | Lee | H05B 33/0815 |
| 2013/0234614 | A1 | 9/2013 | Yu et al. | |

* cited by examiner

POWER TRANSFORMATION APPARATUS, ILLUMINATING LAMP, AND LAMP TUBE USING THE SAME

BACKGROUND OF THE INVENTION

1. Field of the Invention

The present invention relates to a power transformation apparatus, more particularly to a power transformation apparatus connected between DC light element and ballast.

2. Description of the Prior Art

At present, using LED in place of the traditional fluorescent lamp is the current trend. Furthermore, the traditional fluorescent lamp is classified into two kinds: inductive ballast and electrical ballast. The inductive ballast is an inductance manufactured by entwining iron core. The iron core is composed of enamel insulated wire and Silicon steel. The electric light source is operated by the electrical ballast using electronic technology in order to produce an electronic apparatus for lighting. However, the AC power provided by the ballast couldn't be used in the DC light element (e.g., Light-Emitting Diode). A power transformation apparatus is needed to convert the AC power into the DC power. The DC power could be used in the DC light element, for example, the Taiwan's patent I401991 discloses a power transformation apparatus.

However, the first fluorescent imitating module and the second imitating module of the Taiwan's patent I401991 have a character of low impedance value (Usually less than 1Ω). As a result, when the power transformation apparatus of the Taiwan's patent I401991 is connected to specific types of the electrical ballast, the operation of the power transformation apparatus is easy to failure. For example, when the power transformation apparatus is connected to a pre-heated start ballast, the power transformation apparatus would be burned because the impedance value of the power transformation apparatus is too low. In addition, when the power transformation apparatus is connected to an instant start ballast, the first fluorescent imitating module and the second imitating module would easily be burned because the instant start ballast uses a high-voltage transient starting the lamb (the starting voltage is 800-4200V), and the first fluorescent imitating module and the second imitating module couldn't endure receiving a transient high-voltage. Furthermore, when the power transformation apparatus is connected to a rapid start ballast (the rapid start ballast keeps a low-voltage value), the first fluorescent imitating module and the second imitating module couldn't continue to light because they couldn't keep a low-voltage value.

Therefore, Applicant is going to improve the above power transformation apparatus in order to be operating properly when it is connected to the pre-heated start ballast, the instant start ballast, or the rapid start ballast.

SUMMARY OF THE INVENTION

In order to solve the above problem, one object of the present invention is to provide a power transformation apparatus. When the power transformation apparatus is connected to the pre-heated start ballasts, the instant start ballasts, or the rapid start ballasts, it is operating properly.

A power transformation apparatus of the present invention is provided. The power transformation apparatus between a DC light element and a ballast includes a first inductance including, a second inductance and a rectifier module. The first inductance includes a first input terminal and a second input terminal, and wherein at least one of the first input terminal and the second input terminal is electrically connected to an output terminal of the ballast. The second inductance includes a third input terminal and a fourth input terminal, and wherein at least one of the third input terminal and the fourth input terminal is electrically connected to another output terminal of the ballast. The rectifier module includes a first rectifier input terminal and a second rectifier input terminal, and wherein the first rectifier input terminal is electrically connected to the first inductance and the second rectifier input terminal is electrically connected to the second inductance. The rectifier module is configured to provide a direct current to the DC light element. When the ballast is an electrical ballast, an impedance value of the first inductance and an impedance value the second inductance are between 150Ω and 800Ω.

In the aforementioned power transformation apparatus, the power transformation apparatus further comprises a first capacitor and a second capacitor, and wherein the first capacitor is connected to the first inductance in parallel, and the second capacitor is connected to the second inductance in parallel.

In the aforementioned power transformation apparatus, the power transformation further includes a flow restrictor and a switch, and wherein the flow restrictor is disposed among the first inductance, the second inductance and the rectifier module. The switch is connected to the flow restrictor in parallel, and the impedance value of the switch is less than the impedance value of the flow restrictor. When the ballast is an inductive ballast, the switch is turned on, and when the ballast is an electrical ballast, the switch is turned off.

An illuminating lamp is provided. The illuminating lamp is electrically connected an alternating current. The illuminating lamp includes at least one DC light element, a ballast and a power transformation apparatus as claimed in the aforementioned. The power transformation apparatus is connected between the DC light element and the ballast. For example, The DC light element is a Light-Emitting Diode.

A lamp tube is provided. The lamp tube includes a lamp housing and a ballast, at least one DC light element, and a power transformation apparatus as claimed in aforementioned. The power transformation apparatus is connected between the DC light element and the ballast, and the DC light element and the power transformation apparatus are disposed in the lamp housing.

DESCRIPTION OF THE PREFERRED EMBODIMENTS

Figure 1:
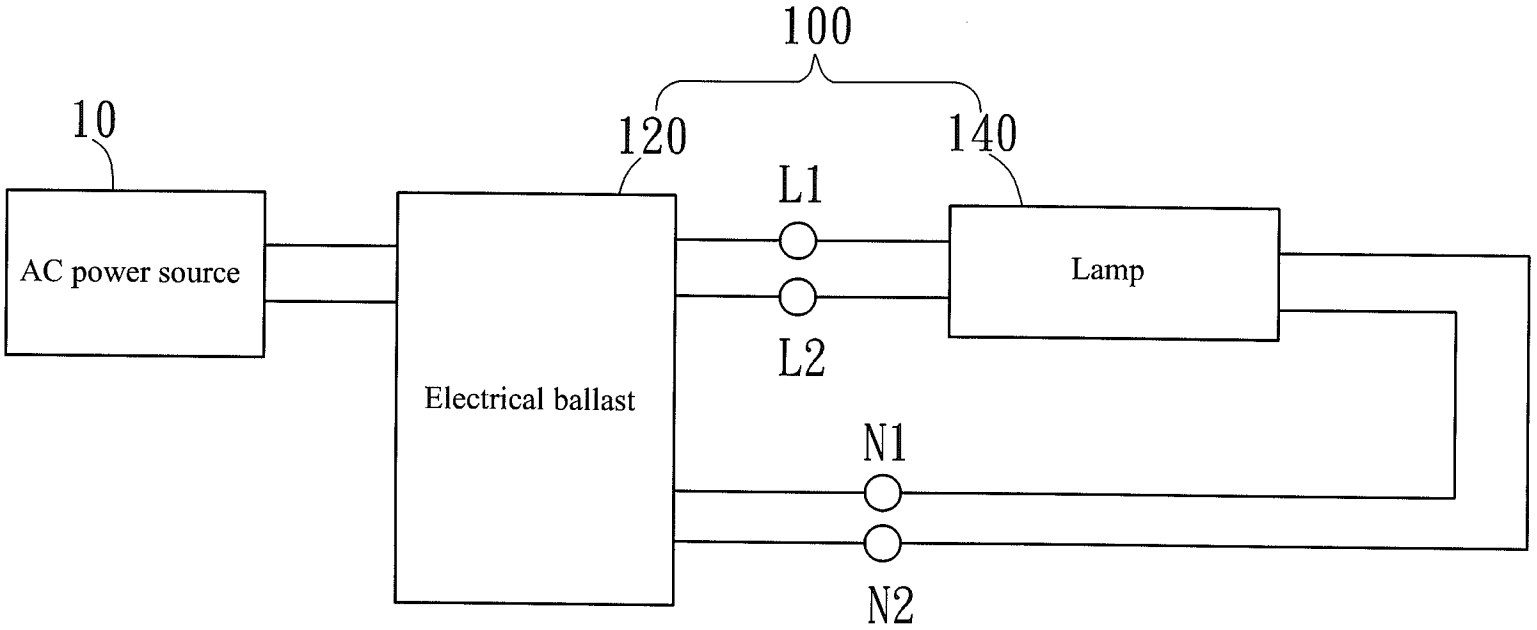
FIG. 1 illustrates a schematic diagram of an illuminating lamp in accordance with the first embodiment of the present invention.
Figure 2:
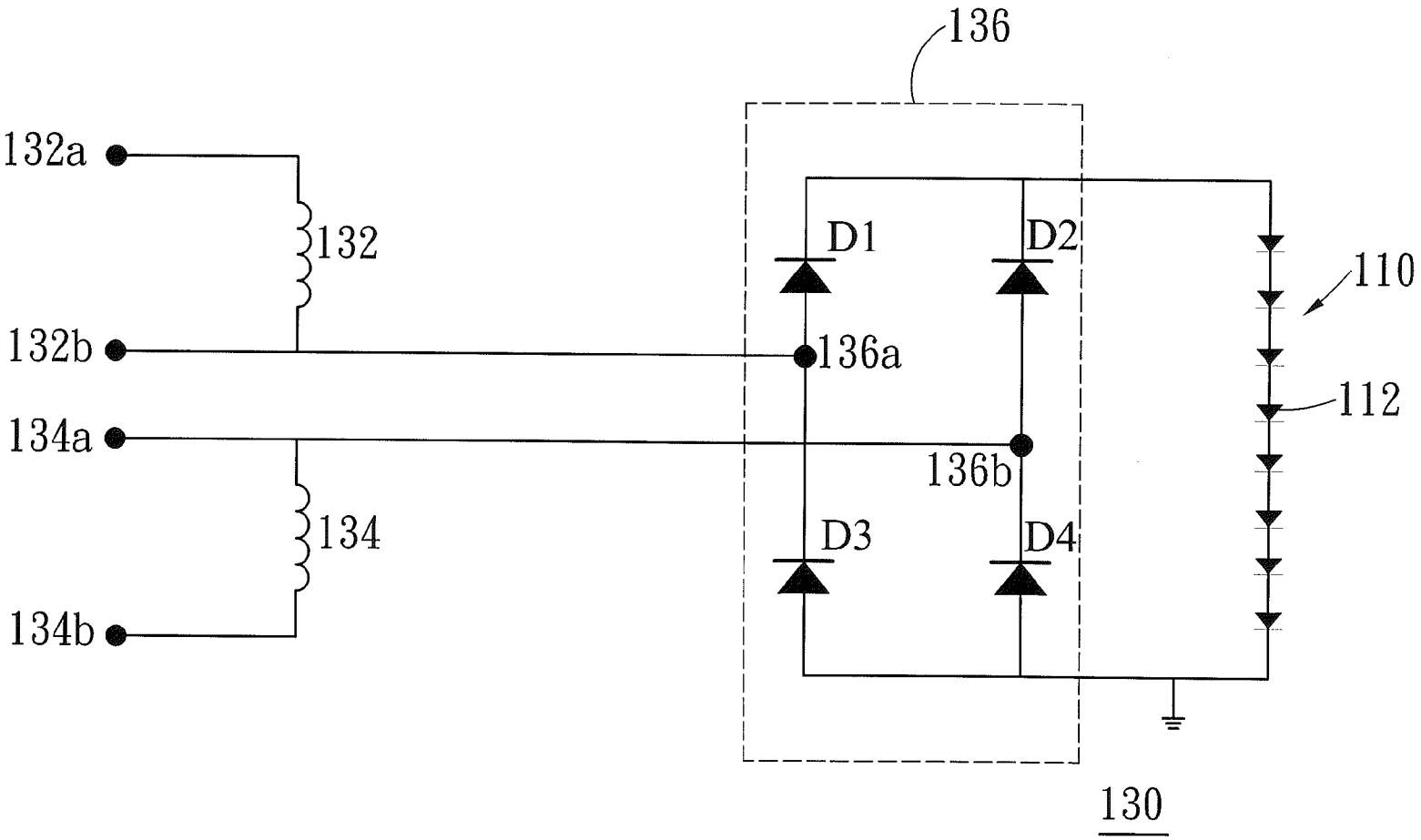
FIG. 2 illustrates a circuit diagram of a power transformation apparatus in accordance with the first embodiment of the present invention.

Please refer to FIG. 1 and FIG. 2. FIG. 1 illustrates a schematic diagram of an illuminating lamp in accordance with the first embodiment of the present invention and FIG. 2 illustrates a circuit diagram of a power transformation apparatus in accordance with the first embodiment of the present invention. The illuminating lamp 100 is electrically connected to an AC power source 10. The illuminating lamp 100 includes a light module 110, an electrical ballast 120, and a power transformation apparatus 130. The light module 110 and the power transformation apparatus 130 are disposed in a lamp housing of a lamp 140. The appearance of the lamp 140 is the same as the appearance of the traditional fluorescent lamp.

Please refer to FIG. 2. The power transformation apparatus 130 includes a first inductance 132, a second inductance 134 and a rectifier module 136. The first inductance 132 includes a first input terminal 132*a* and a second input terminal 132*b*. The first input terminal 132*a* and the second input terminal 132*b* are electrically connected to an output terminal L1 and an output terminal L2 of the electrical ballast 120, respectively. Moreover, the second inductance 134 includes a third input terminal 134*a* and a fourth input terminal 134*b*. The third input terminal 134*a* and the fourth input terminal 134*b* are electrically connected to an output terminal N1 and an output terminal N2 of the electrical ballast 120, respectively. Furthermore, the rectifier module 136 includes a first rectifier input terminal 136*a* and a second rectifier input terminal 136*b*. The first rectifier input terminal 136*a* is electrically connected to the first inductance 132. The second rectifier input terminal 136*b* is electrically connected to second inductance 134. An output terminal of the rectifier module 136 is connected to the light module 110.

The light module 110 includes at least one DC light element 112. For example, the DC light element 112 is a Light-Emitting Diode. The rectifier module 136 is configured to provide a direct current to the DC light element 112. In accordance with the embodiment of the present invention, the rectifier module 136 is achieved by a full-wave bridge rectifier circuit. The full-wave bridge rectifier circuit consists of four rectifier diodes.

It's worth noting that the electrical ballast 120 is designed for a negative resistance of a gas discharge light source (e.g., fluorescent lamp). The alternating current is provided by the output terminals L1, L2 and the output terminals N1, N2, but the alternating current couldn't be used for the DC light element 112. As a result, the first inductance 132 and the second inductance 134 use an equivalent circuit method to simulate the negative resistance of the gas discharge light source. In other words, the first inductance 132 and the second inductance 134 are used to simulate a filament of the fluorescent lamp. In addition, the alternating current outputted from the output terminals L1, L2 and the output terminals N1, N2 are converted by the rectifier module 136 into the direct current, and the direct current is provided to the DC light element 112. In other words, a loading generated by the power transformation apparatus 130 and the light module 110 has the character of the negative resistance like the gas discharge light source, so the power transformation apparatus 130 and the light module 110 could replace the gas discharge light source. Therefore, the power transformation apparatus 130 and the light module 110 could be used with the illuminating lamp including the electrical ballast 120. As a result, the power transformation apparatus 130 and the light module 110 could be used with all kinds of ballasts on the market.

Although the description above contains many specifics, these are merely provided to illustrate the invention and should not be construed as limitations of the invention's scope. Thus it will be apparent to those skilled in the art that various modifications and variations can be made in the system and processes of the present invention without departing from the spirit or scope of the invention.

In accordance with the embodiment of the present invention, the AC power source 10 for example is a utility power. An output frequency of the AC power source 10 is 60 Hz, and an output frequency of the electrical ballast 120 is between 20 kHz and 60 kHz. In this case, an impedance value of the first inductance 132 and an impedance value of the second inductance 134 are between 150Ω and 800Ω. Therefore, in accordance with the formula "impedance value=2πfL" ("f" is frequency and "L" is inductance value.), an inductance value of the first inductance 132 and an inductance value of the second inductance 134 are between 0.4 mH and 6.4 mH.

In accordance with multiple experiments carried out by the inventor of the present invention, when the impedance value of the first inductance 132 and the impedance value of the second inductance 134 are between 150Ω and 800Ω, the power transformation apparatus 130 would work well and is not easy to be burned no matter the power transformation apparatus 130 is electrically connected with the pre-heated start ballast, the instant start ballast, or the rapid start ballast. In one of the experiments, an electrical ballast (Model: FX-14AEF-BS) produced by TOA corporation is used. The electrical ballast (Model: FX-14AEF-BS) is a Pre-heated start ballast. If the impedance value of the first inductance 132 and the impedance value of the second inductance 134 are less than 100Ω, an inductance of the power transformation apparatus 130 or a resistor of the power transformation apparatus 130 will be burned every time. In addition, the electrical ballast (Model: FX-14AEF-BS) will also be burned. On the contrary, when the impedance value of the first inductance 132 and the impedance value of the second inductance 134 are more than 800Ω, the electrical ballast (Model: FX-14AEF-BS) is not easy to be started. Moreover, when the impedance value of the first inductance 132 and the impedance value of the second inductance 134 are more than 800Ω, the electrical ballast (Model: FX-14AEF-BS) would waste a lot of power even if the electrical ballast (Model: FX-14AEF-BS) could work.

Figure 3:
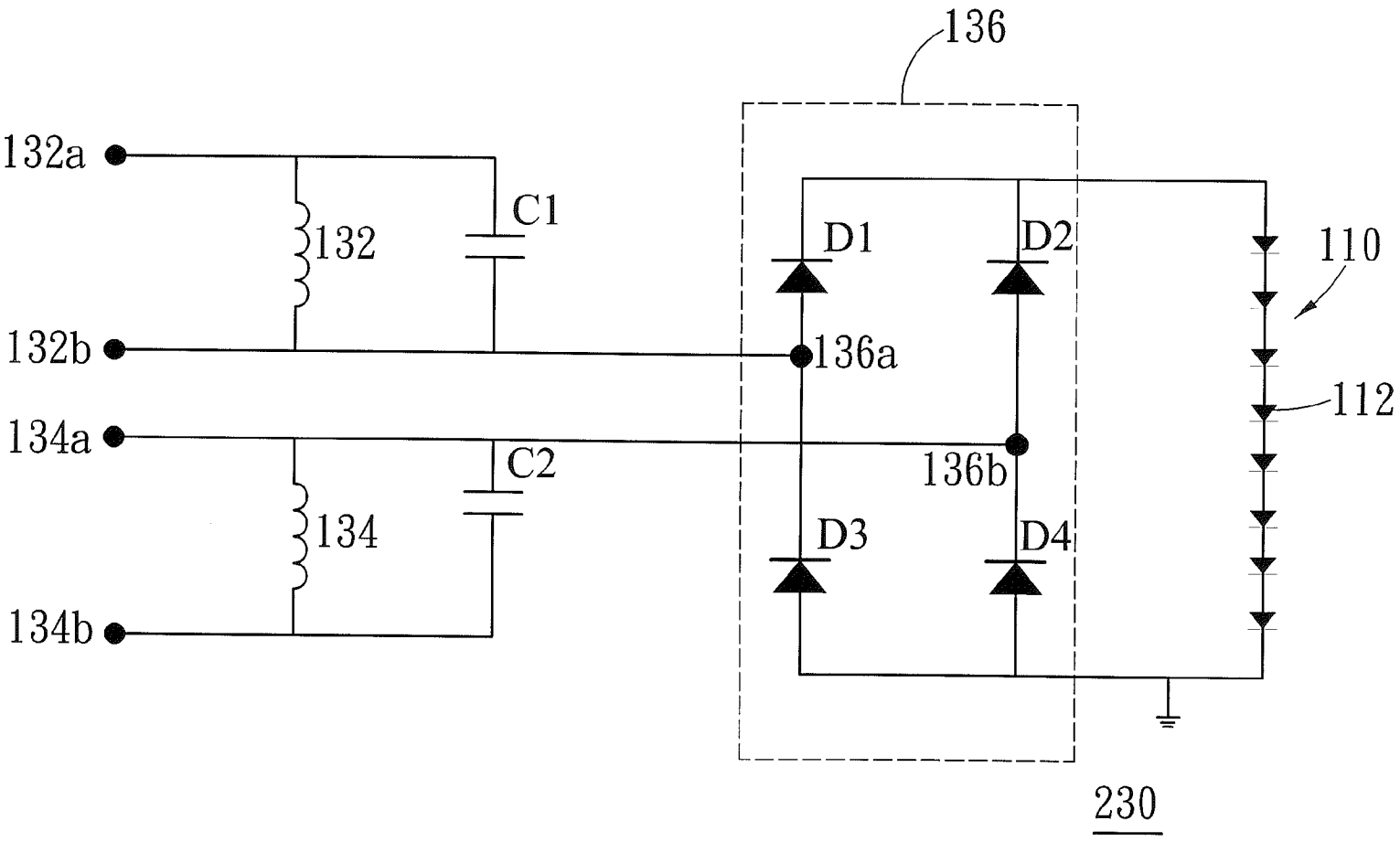
FIG. 3 illustrates a circuit diagram of the power transformation apparatus in accordance with the second embodiment of the present invention.

Please refer to FIG. 3. FIG. 3 illustrates a circuit diagram of the power transformation apparatus in accordance with the second embodiment of the present invention. The power transformation apparatus 230 further includes a first capacitor C1 and a second capacitor C2, wherein the first capacitor C1 is connected to the first inductance 132 in parallel and the second capacitor C2 is connected to the second inductance 134 in parallel. In addition, the first capacitor C1 and the second capacitor C2 could absorb high voltage surge.

Figure 4A:
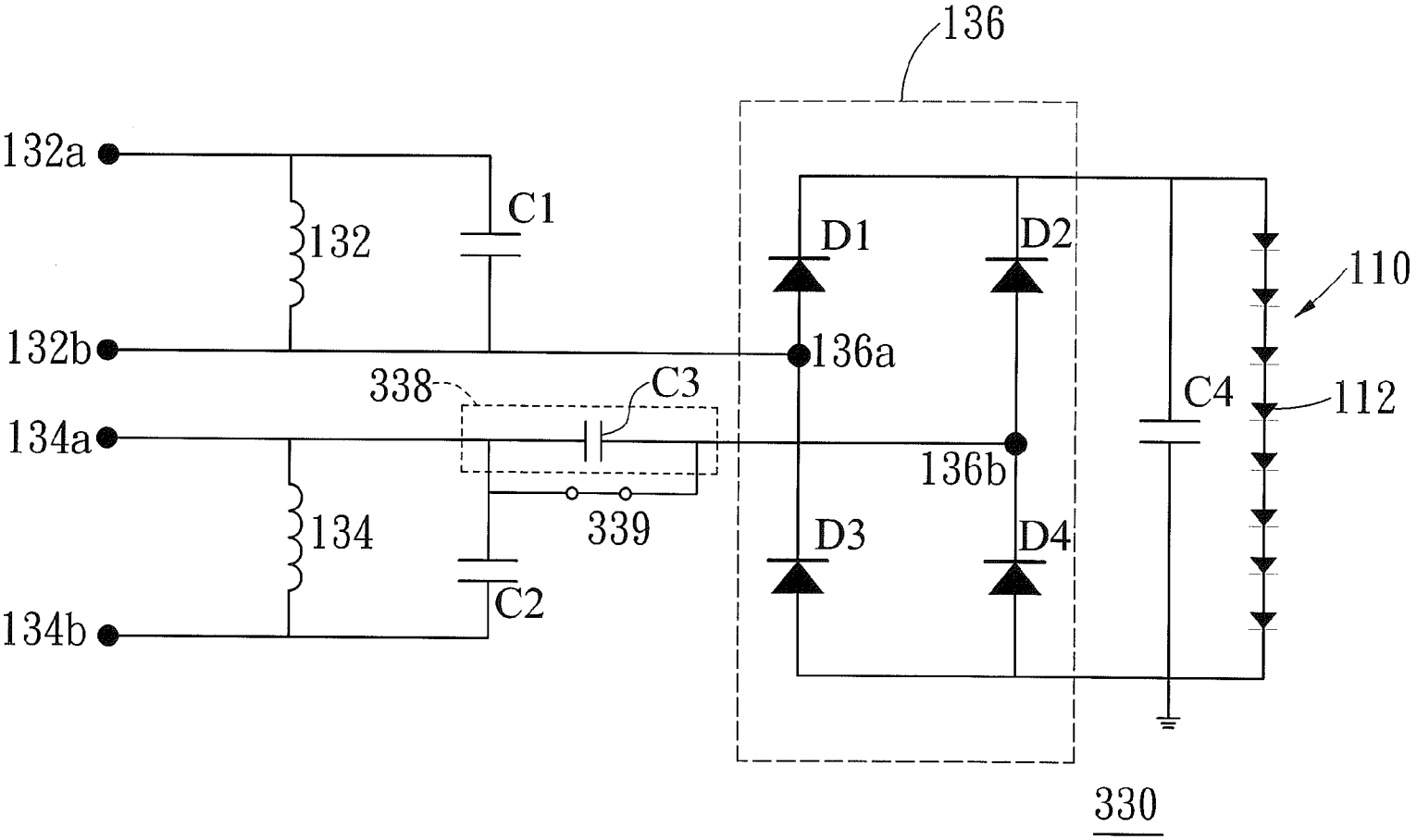
FIG. 4A and FIG. 4B illustrate a circuit diagram of the power transformation apparatus in accordance with the third embodiment of the present invention.

Please refer to FIG. 4A. FIG. 4A illustrates a circuit diagram of the power transformation apparatus in accordance with the third embodiment of the present invention. The power transformation apparatus 330 further includes a flow restrictor 338 and a switch 339. The flow restrictor 338 is disposed between the output terminal of the second inductance 134 and the input terminal of the rectifier module 136. The switch 339 is connected to the flow restrictor 338 in parallel and an impedance value of the switch 339 is far less an impedance value of the flow restrictor 338. When the power transformation apparatus 330 is connected to the electrical ballast 120 (Please refer to FIG. 1), the switch 339 is in a closed state. Therefore, the current is not through the flow restrictor 338.

Figure 4B:
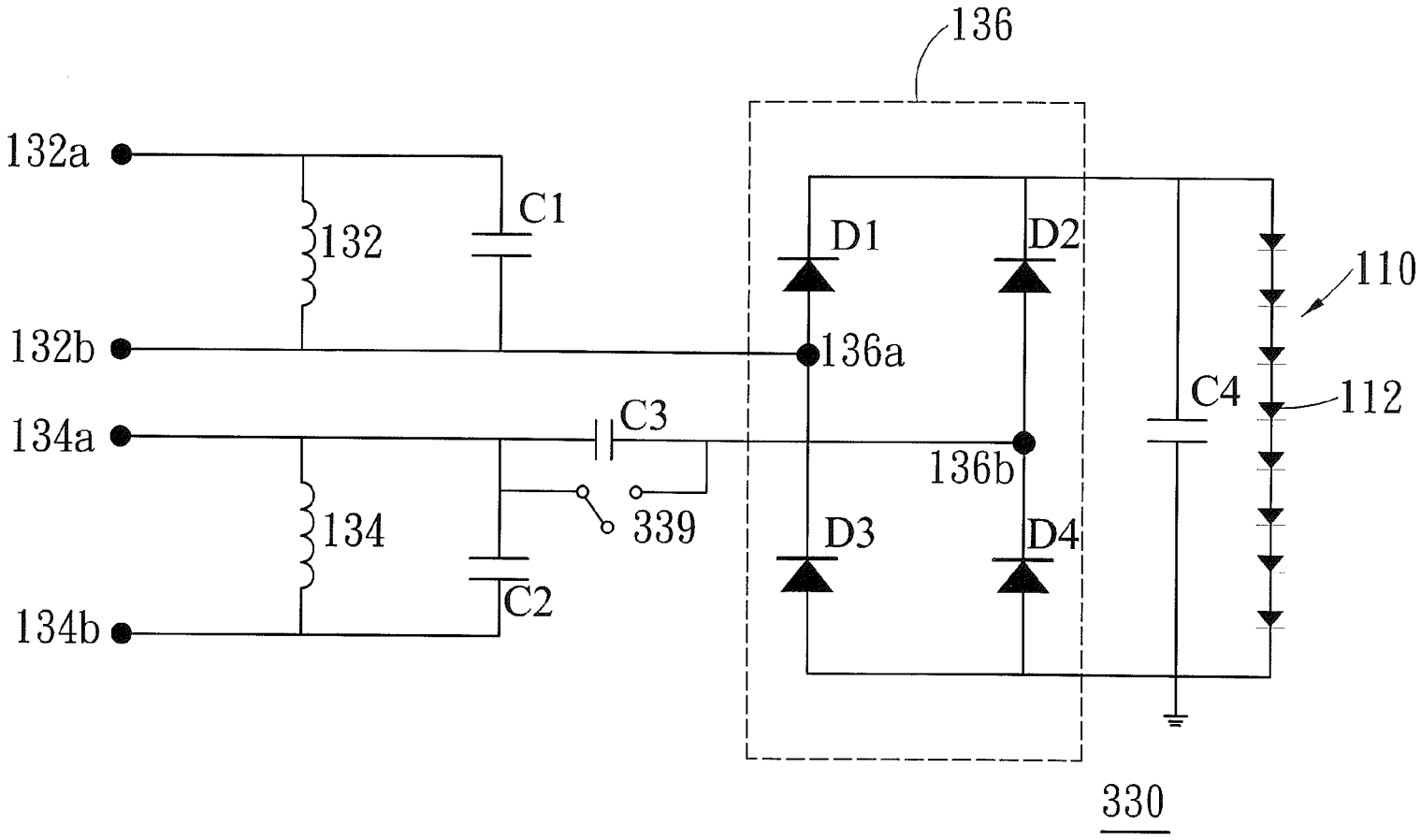
Figure 5:
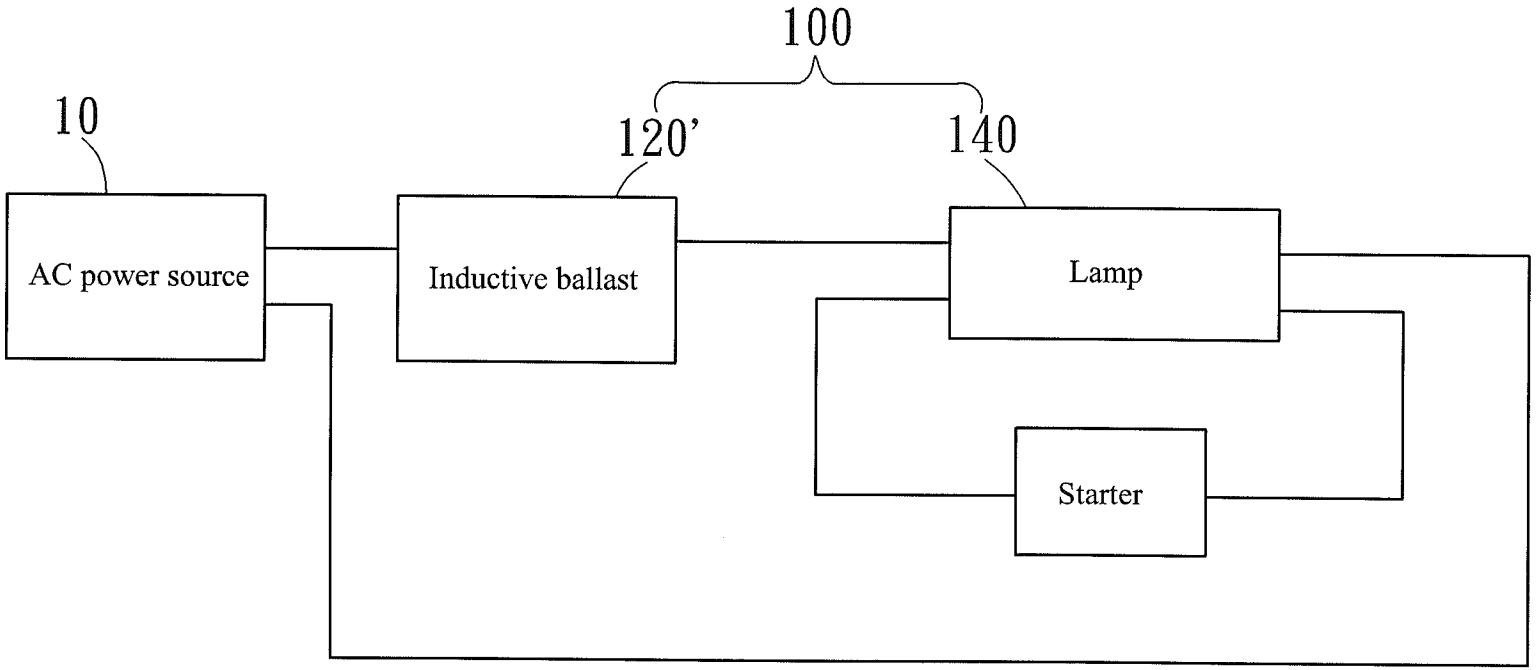
FIG. 5 illustrates a schematic diagram of an illuminating lamp in accordance with the third embodiment of the present invention.

However, when the power transformation apparatus 330 is connected to the electrical ballast 120' (please refer to FIG. 5) or directly connected to the AC power source 10, the switch 339 is in an open state (please refer to FIG. 4B). Therefore, the current is through the flow restrictor 338. The reason for the above design is described below. When the power transformation apparatus 330 is connected to the electrical ballast 120' or directly connected to the AC power source 10, a frequency of the direct current received by the power transformation apparatus 330 is 60 Hz. At the same time, the impedance value of the first inductance 132 and the impedance value of the second inductance 134 become very less, so they need the flow restrictor 338 to reduce their voltage.

Furthermore, please keep on referring to FIG. 4B. The flow restrictor 338 could further be connected to the third capacitor C3 in parallel. The third capacitor C3 could absorb high voltage surge and prevent the flow restrictor 338 to be damaged. The power transformation apparatus 130 further includes the fourth capacitor C4 and the fourth capacitor C4 is connected to the light module 110 in parallel. The fourth capacitor C4 is as a filter capacitor. In addition, the flow restrictor 338 could also be between an output terminal of the first inductance 132 and the rectifier input terminals of the rectifier module 136.

Although the description above contains many specifics, these are merely provided to illustrate the invention and should not be construed as limitations of the invention's scope. Thus it will be apparent to those skilled in the art that various modifications and variations can be made in the system and processes of the present invention without departing from the spirit or scope of the invention.

We claim:

1. A power transformation apparatus between a DC light element and a ballast comprising:

a first inductance including a first input terminal and a second input terminal, wherein at least one of the first input terminal and the second input terminal is electrically connected to an output terminal of the ballast;

a second inductance including a third input terminal and a fourth input terminal, wherein at least one of the third input terminal and the fourth input terminal is electrically connected to another output terminal of the ballast; and a rectifier module including a first rectifier input terminal and a second rectifier input terminal, wherein the first rectifier input terminal is electrically connected to the first inductance and the second rectifier input terminal is electrically connected to the second inductance, and the rectifier module provides a direct current to the DC light element;

wherein when the ballast is an electrical ballast, an impedance value of the first inductance and an impedance value of the second inductance are between 150Ω and 800Ω.

2. The power transformation apparatus of claim 1, wherein the inductance value of the first inductance and the inductance value of the second inductance are between 0.4 mH and 6.4 mH.

3. The power transformation apparatus of claim 1 further comprising a first capacitor and a second capacitor, wherein the first capacitor is connected to the first inductance in parallel and the second capacitor is connected to the second inductance in parallel.

4. The power transformation apparatus of claim 1, further comprising a flow restrictor, wherein the flow restrictor is disposed among the first inductance, the second inductance and the rectifier module.

5. The power transformation apparatus of claim 4, further comprising a switch, wherein the switch is connected to the flow restrictor in parallel, and the impedance value of the switch is less than the impedance value of the flow restrictor; when the ballast is an inductive ballast, the switch is turned on and when the ballast is an electrical ballast, the switch is turned off.

6. An illuminating lamp is electrically connected an alternating current, the illuminating lamp comprising:

at least one DC light element;

a ballast, one input terminal of the ballast connected to the alternating current; and a power transformation apparatus between the DC light element and the ballast comprising:

a first inductance including a first input terminal and a second input terminal, wherein at least one of the first input terminal and the second input terminal is electrically connected to an output terminal of the ballast;

a second inductance including a third input terminal and a fourth input terminal, wherein at least one of the third input terminal and the fourth input terminal is electrically connected to another output terminal of the ballast; and a rectifier module including a first rectifier input terminal and a second rectifier input terminal, wherein the first rectifier input terminal is electrically connected to the first inductance and the second rectifier input terminal is electrically connected to the second inductance, and the rectifier module provides a direct current to the DC light element;

wherein when the ballast is an electrical ballast, an impedance value of the first inductance and an impedance value of the second inductance are between 150Ω and 800Ω.

7. The illuminating lamp of claim 6, wherein the inductance value of the first inductance and the inductance value of the second inductance are between 0.4 mH and 6.4 mH.

8. The illuminating lamp of claim 6, further comprising a first capacitor and a second capacitor, wherein the first capacitor is connected to the first inductance in parallel and the second capacitor is connected to the second inductance in parallel.

9. The illuminating lamp of claim 6, further comprising a flow restrictor, wherein the flow restrictor is disposed among the first inductance, the second inductance and the rectifier module.

10. The illuminating lamp of claim 6, further comprising a switch, wherein the switch is connected to the flow restrictor in parallel, and the impedance value of the switch is less than the impedance value of the flow restrictor; when the ballast is an inductive ballast, the switch is turned on and when the ballast is an electrical ballast, the switch is turned off.

11. The illuminating lamp of claim 6, wherein the DC light element is a Light-Emitting Diode.

12. The illuminating lamp of claim 6 further comprising a lamp tube, wherein the DC light element and the power transformation apparatus are disposed in the illuminating lamp.

13. A lamp tube comprising:

a lamp housing and a ballast;

at least one DC light element; and a power transformation apparatus between the DC light element and the ballast comprising:

a first inductance including a first input terminal and a second input terminal, wherein at least one of the first input terminal and the second input terminal is electrically connected to an output terminal of the ballast;

a second inductance including a third input terminal and a fourth input terminal, wherein at least one of the third input terminal and the fourth input terminal is electrically connected to another output terminal of the ballast; and a rectifier module including a first rectifier input terminal and a second rectifier input terminal, wherein the first rectifier input terminal is electrically connected to the first inductance and the second rectifier input terminal is electrically connected to the second inductance, and the rectifier module provides a direct current to the DC light element;

wherein when the ballast is an electrical ballast, an impedance value of the first inductance and an impedance value of the second inductance are between 150Ω and 800Ω;

wherein the DC light element and the power transformation apparatus are disposed in the lamp housing.

14. The lamp tube of claim 13, wherein the inductance value of the first inductance and the inductance value of the second inductance are between 0.4 mH and 6.4 mH.

15. The lamp tube of claim 13, further comprising a first capacitor and a second capacitor, wherein the first capacitor is connected to the first inductance in parallel and the second capacitor is connected to the second inductance in parallel.

16. The lamp tube of claim 13, further comprising a flow restrictor, wherein the flow restrictor is disposed among the first inductance, the second inductance and the rectifier module.

17. The lamp tube of claim 13, further comprising a switch, wherein the switch is connected to the flow restrictor in parallel, and the impedance value of the switch is less than the impedance value of the flow restrictor; when the ballast is an inductive ballast, the switch is turned on and when the ballast is an electrical ballast, the switch is turned off.

18. The lamp tube of claim 13, wherein the DC light element is a Light-Emitting Diode.

* * * * *